US007527663B2

(12) United States Patent
Riedo

(10) Patent No.: US 7,527,663 B2
(45) Date of Patent: May 5, 2009

(54) VENTILATION SYSTEM PROVIDING NBC PROTECTION

(75) Inventor: Hans Riedo, Rheinan (CH)

(73) Assignee: Andair AG (CH)

( * ) Notice: Subject to any disclaimer, the term of this patent is extended or adjusted under 35 U.S.C. 154(b) by 371 days.

(21) Appl. No.: 10/558,002

(22) PCT Filed: May 19, 2004

(86) PCT No.: PCT/CH2004/000304

§ 371 (c)(1),
(2), (4) Date: Nov. 22, 2005

(87) PCT Pub. No.: WO2004/103475

PCT Pub. Date: Dec. 2, 2004

(65) Prior Publication Data

US 2007/0017510 A1 Jan. 25, 2007

(30) Foreign Application Priority Data

May 22, 2003 (CH) ..... 0924/03

(51) Int. Cl.
*B01D 46/00* (2006.01)
*B01D 50/00* (2006.01)

(52) U.S. Cl. ..... 55/385.2; 55/467; 55/417; 55/469; 55/486; 55/505; 96/422; 109/1 S; 454/902

(58) Field of Classification Search ..... 55/385.2, 55/467, 417, 469, 486, 505; 96/422; 109/1 S; 454/902

See application file for complete search history.

(56) References Cited

U.S. PATENT DOCUMENTS

| | | | | |
|---|---|---|---|---|
| 2,014,840 | A * | 9/1935 | Geiger et al. | 454/252 |
| 3,075,448 | A * | 1/1963 | Cohen | 454/194 |
| 3,363,540 | A * | 1/1968 | Mason | 454/194 |
| 4,631,872 | A * | 12/1986 | Daroga | 52/1 |
| 4,707,953 | A * | 11/1987 | Anderson et al. | 52/63 |
| 5,115,613 | A * | 5/1992 | McCarthy | 52/169.6 |
| 6,328,775 | B1 * | 12/2001 | Fuchs | 55/385.2 |

FOREIGN PATENT DOCUMENTS

| | | |
|---|---|---|
| DE | 8815460.2 U | 3/1989 |
| DE | 3841895 A1 | 6/1990 |
| EP | 0678693 B1 | 10/1995 |
| GB | 398785 A | 9/1933 |
| NL | 9101522 A | 4/1993 |
| WO | WO 97/30755 A1 | 8/1997 |

* cited by examiner

*Primary Examiner*—Duane S Smith
*Assistant Examiner*—Minh-Chau T Pham
(74) *Attorney, Agent, or Firm*—Bachman & LaPointe, P.C.

(57) ABSTRACT

A ventilation system providing NBC protection for at least one closed security space and/or protection space with constant slight excess pressure, the ventilation system substantially having an air inlet and air outlet, an explosion protection valve, a prefilter, a filter for suspended matter, an activated carbon filter and an air conveying device for sucking in the air to be purified and for distributing the purified air, and wherein the ventilation system has at least one of the three following built-in elements: an explosion protection valve which is combined with and cooperates with the prefilter; a combined activated carbon filter made of activated carbon which is specifically effective against biological and/or chemical toxic substances, on the one hand and, on the other hand, against radionuclides; and an air pump configured as a double bellows.

10 Claims, 3 Drawing Sheets

VENTILATION SYSTEM PROVIDING NBC PROTECTION

BACKGROUND OF THE INVENTION

The invention relates to a ventilation system providing NBC protection for at least one closed security space and/or protection space with constant slight excess pressure, which ventilation system substantially comprises an air inlet and air outlet, an explosion protection valve, a prefilter, a filter for suspended matter, an activated carbon filter and an air conveying device for sucking in the air to be purified and for distributing the purified air.

An air purification apparatus is known from WO 97/30755 A1, which comprises means for sucking in, purifying and distributing external air in at least one closed space, in particular in security and/or protection spaces. The apparatus is configured as an autonomous built-in unit with an air-tight housing, an air inlet connection piece for the air to be purified and an outlet connection piece. The housing surrounds a ventilator, at least one unused filter unit packed in an air-tight manner and an integrated bypass for the filter units. According to a special embodiment, two different filter units can be installed, which have different activated carbon filters. Depending on the damage position, one or other of the filter units can be used, both are immediately reachable at any time and fully functional. The purified air is blown constantly into the security and/or protection spaces, where with the generation of a lasting, slight excess pressure, it continuously escapes through leakages in the spaces and/or an excess pressure valve.

A filter unit is also known form DE 3841895 A1 which is preferably cylindrical and consists of individual filters which are nested together. In their totality, these individual filters ensure protection against atomic, biological and chemical toxic substances, in other words NBC protection. A ventilator which is flanged on externally is provided to operate the device. When the ventilation system is being fitted care has to be taken in a complex manner that all components are matched to one another both in terms of construction and also with regard to their functional characteristics.

During test runs of a ventilation system, which have to be carried out regularly, the functioning of all components involved and the adequate tightness of the security and/or protection spaces is checked. In the process, it must also be shown that a specified excess pressure in the space is constantly achieved during use.

Ventilation apparatuses are also known, for example from EP 0678693 B1, in which an explosion protection valve with a separately mounted prefilter is installed at the air inlet into the security and/or protection space. Furthermore, there are ventilation apparatuses, in which a prefilter is installed directly in the apparatus. The explosion protection valve is in turn arranged separately, it is installed without a prefilter in the security and/or protection space wall, or the explosion protection is dispensed with.

SUMMARY OF THE INVENTION

With regard to the initial situation described above, the inventor has set himself the task of providing a ventilation system of the type mentioned at the outset, which is economical to produce, easy to put into operation and to operate and is not prone to failure.

The object is achieved according to the invention in that the ventilation system comprises at least one of the three following elements:

An explosion protection valve which is combined with and cooperates with the prefilter.

A combined activated carbon filter made of activated carbon which is specifically effective against chemical toxic substances, on the one hand and, on the other hand, against radionuclides.

An air pump configured as double bellows.

Special and developing embodiments of the invention are the subject of dependent claims.

The present application contains ventilation systems with:

a respective built-in element configured according to the invention from the group consisting of prefilter/explosion protection valve, activated carbon filter and double bellows, or two respective built-in elements configured according to the invention from the group consisting of prefilter/explosion protection valve, activated carbon filter and double bellows or all three built-in elements according to the invention, prefilter/explosion protection valve, activated carbon filter and double bellows.

An explosion protection valve which is combined and cooperates according to the invention with the prefilter is distinguished in that an elastically compressible prefilter pad is held between a rigidly mounted plate with a first perforation and a moveable plate which can be displaced in the direction of the stationary plate. In normal operation, the external air can enter without problems through the two impact-resistant plates and the prefilter pad. In the event of a sudden excess pressure, in particular an explosion, the displaceable plate is hurled with great impact against the stationary plate and thus compresses the prefilter pad. The first and second perforations are configured such that the plates located one above the other do not allow any air through. This may be achieved, for example, with perforations, for example hole perforations, which are offset with respect to one another. Obviously, any other form of perforation is also suitable, for example slots in the radial direction. When the explosion pressure dies away, the elastic prefilter pad pushes the moveable plate of the explosion protection valve back into the original position and the passage of air is again ensured.

The explosion protection valve which is combined with and cooperates with the prefilter does not only protect the sensitive, downstream filter for suspended matter from the actions of pressure, but also people and things which are present in the space. The housing of the ventilation system is also protected with the combined prefilter/explosion protection valve if a sudden excess pressure phase occurs without a devastating pressure wave destroying the entire built-in unit. In the process, the closures and separation points are above all protected from the effects of explosions. The pressure reduction takes place in the stable, reinforced housing cover at the air inlet.

A combined activated carbon filter according to the invention basically comprises:

a first layer and a second layer, each layer being specifically effective against chemical warfare agents or against radionuclides, the layers being granule-like, powder-like or configured as a solid body in the form of an open-pored structure or a single-layer activated carbon filter made of a granulate, powder or open-pored substrate which is effective specifically against chemical gaseous toxic substances and a granulate, powder or open-pored substrate specifically effective against radionuclides ejected into the atmosphere. The activated carbon filter may be disc-shaped with an axial gas through-flow or annular with a radial gas through-flow from the inside out or from the outside in.

In each case, however, a filter for suspended matter is connected upstream and separates the fine suspended matter, above all the aerosols of biological and chemical warfare agents.

The activated carbon is impregnated in a manner which is known per se for use against biological and/or chemical threats such that the toxic substances are removed by adsorption, chemisorption or catalytic oxidation from the gas flow. The activated carbon which is used against threats with radioactive atmosphere is, on the other hand, impregnated such that adsorption or ion exchange takes place. For example radioactive methyl iodide, which can be released in nuclear power station accidents, can thus be removed from the gas through-flow.

As mentioned, it is always of crucial importance that a slight excess pressure is maintained in a security and/or protection space. This normally takes place with a power-driven ventilator. In order to ensure that security and/or protection space occupants are adequately supplied with air for breathing, i.e. oxygen, and to ensure removal of the used air, i.e. $CO_2$, in the event of a power failure, which is not unusual in the event of war or catastrophes, emergency operation of the ventilation is generally provided. The emergency operation, as mentioned, is used to build up a slight excess pressure in the protection space in order to prevent the penetration of loaded and/or contaminated air. Ventilators with emergency power units, batteries and transmission gearings driven by hand or with the feet are conventional for emergency operation. The use of bellows is also known as an emergency operation. The disadvantage of bellows consists in that the air is supplied in bursts. This, in turn, results in twice the air quantity having to be supplied for about 50% of the time in the case of a specified minimum air quantity per time unit. To detoxify contaminated air, the contact time, i.e. the time in which the air flows through the activated carbon, is decisive. During operation with bellows of the known type the contact time in the gas filter with a specified quantity of air is reduced to about 50% as a result of the loading in bursts.

With the double bellows according to the invention this disadvantage is eliminated, with each movement to actuate the double bellows, air is sucked into a suction chamber and one of the bellows-shaped air chambers arranged on either side is constantly filled with filtered air and the other air chamber to the same degree ejects air into the security and/or protection space. There is no interruption during the suction phase, as is the case with a conventional bellows.

In the simplest case, the double bellows is the only air pump. However, the actuation of a double bellows according to the invention is generally only necessary in an emergency, if the electric power fails or a defect has to be eliminated. The latter may preferably be attached with a quick-release fastener to the air outlet opening of the ventilation system.

Each ventilation system for ventilation and/or protection spaces can be decisively and individually improved in a simple manner with the present invention. Depending on requirement, the three built-in elements according to the invention, prefilter/explosion protection device, combined activated carbon filter and double bellows can be installed individually, in twos or all three combined and this makes possible a broad adaptable application range.

BRIEF DESCRIPTION OF THE DRAWINGS

The invention will be described in more detail with reference to the embodiments which are shown in the drawings and which are also the subject of dependent claims. In the drawings, schematically:

DETAILED DESCRIPTION

Figure 2:
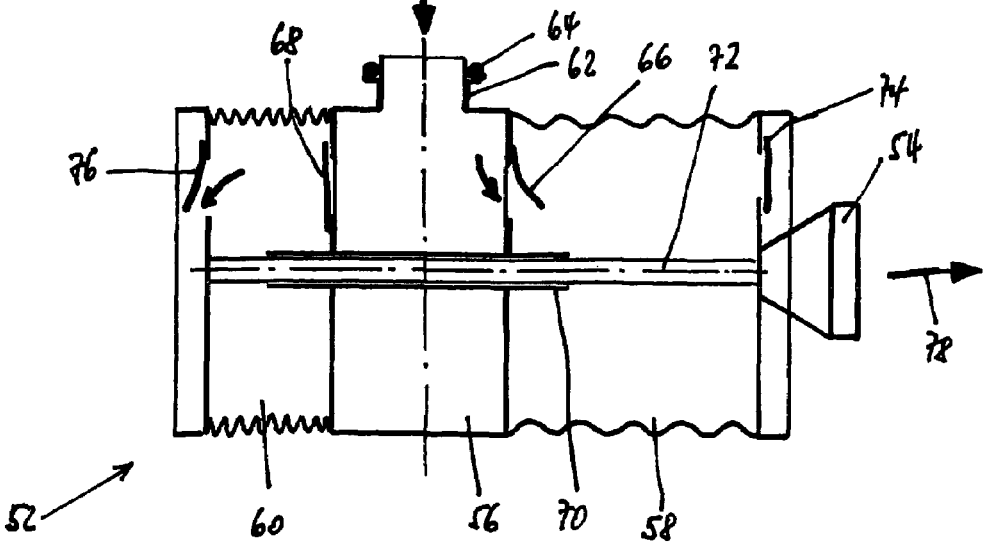
FIG. 2 shows a double bellows.

A ventilation system 10 is mounted with a holder, not visible, on an internal wall of a security and/or protection space 12. All essential functional components are mounted in a two-part housing 14 with an air inlet 16 and an air outlet 18 with a quick-release fastener 20 for the double bellows (FIG. 2). A cover 17 which can be placed on is solidly reinforced relative to the housing 14 located below and is connected thereto via a closure, not shown. An air supply hose or tube 22 is connected to the air inlet 16, shown by dashed lines, and sealed by an O-ring 24. Installed on the input side in the housing 14 is a prefilter in the form of a prefilter pad 26, which is combined with an explosion protection valve 28 and cooperates therewith. The elastically compressable prefilter pad 26 rests on a stationary, i.e. rigidly mounted, plate 30 made of impact-resistant material, in particular steel, with a first perforation 32. A corresponding moveable plate 34 with a second perforation 36 rests on the prefilter pad 26. This moveable plate 34 can be displaced in the direction L, of the longitudinal axis of the ventilation system 10, without rotary movement. The cooperation of the first and second perforation 32, 36 is shown in more detail in FIGS. 4 and 5.

The explosion protection valve 28 is used to protect a downstream, conventional commercial filter 38 for suspended matter, which would be damaged without protection during an excess pressure phase, in particular in the event of an explosion.

After the filter 38 for suspended matter, the air, as characterised by arrows, flows onward in the axial direction through an activated carbon filter 40, which in the present case consists of two disc-shaped filter parts with an open-pored solid body structure:

A C filter 42 made of a specially impregnated activated carbon removes chemical toxic substances, in particular also warfare agents, by adsorption, chemisorption or catalytic oxidation.

An N filter 44, also disc-shaped, removes radioactive material, so-called radionuclides, by adsorption or ion exchange. In the event of a nuclear power station accident, radioactive methyl iodide would be released and removed by the N filter 44.

A ventilator 46 with an electric motor 48 and a silencer 50 is arranged in the lower part of the housing. The external air sucked in by the connected ventilator 46 flows, as shown by arrows, through the air inlet 16, the explosion protection valve 28 with the prefilter 26, the filter 38 for suspended matter and the activated carbon filter 40, always substantially in the axial direction, and is guided through the silencer 50 to the air outlet 18 with a quick-release fastener 20 into the security and/or protection space 12.

A double bellows according to FIG. 2 substantially comprises a suction chamber 56 flanged onto the air outlet 18 (FIG. 1) via the quick-release fastener 20 and two air chambers 58, 60 which form a double-acting air pump.

In the event of a power failure or a defect in the ventilator 46 with the electric motor 48, an air pump configured as double bellows 52 can be attached with few hand movements via the quick-release fastener 20. This ensures that the security and protection space occupants are supplied adequately with air for breathing (oxygen) and ensures the removal of the used air ($CO_2$). The double bellows 52 can be actuated by pulling and pushing on a handle 54. Obviously, the handle 54 can also be configured as a foot pedal so pump operation can be maintained with the substantially stronger legs.

The suction chamber 56 is flanged on at the quick-release closure 20 (FIG. 1) via an air inlet connection piece 62 and sealed with an O-ring 64. The suction chamber 56 also comprises a respective suction valve 66, 68 which open for the inflow of filtered air into the relevant air chamber 58, 60. Finally, the suction chamber 56 is traversed by a guide sleeve 70 running at right angles to the longitudinal axis L, for an actuating rod 72 connected to the operating handle 54 to enlarge and reduce the air chambers 58, 60.

Each air chamber 58, 60 has an outlet valve 74, 76 at the outer end face.

For emergency operation of the ventilation system 10, in which the double bellows 52 is integrated after flanging on, the operating handle 54 is firstly pulled in the direction of the arrow 78. In the increasing air chamber 58, a vacuum develops, the outlet valve 74 remains closed, the suction valve 66 is opened and a vacuum also occurs as a result in the suction chamber 56 and the ventilation system 10. External air is sucked into the ventilation system 10, although the ventilator 46 is not in operation. At the same time, when pulling the operating handle 54, an excess pressure occurs in the air chamber 60, the filtered air of which is ejected via the outlet valve 76 into the security and/or protection space 12. The suction valve 68 is closed because of the vacuum in the suction chamber 56.

Figure 3:
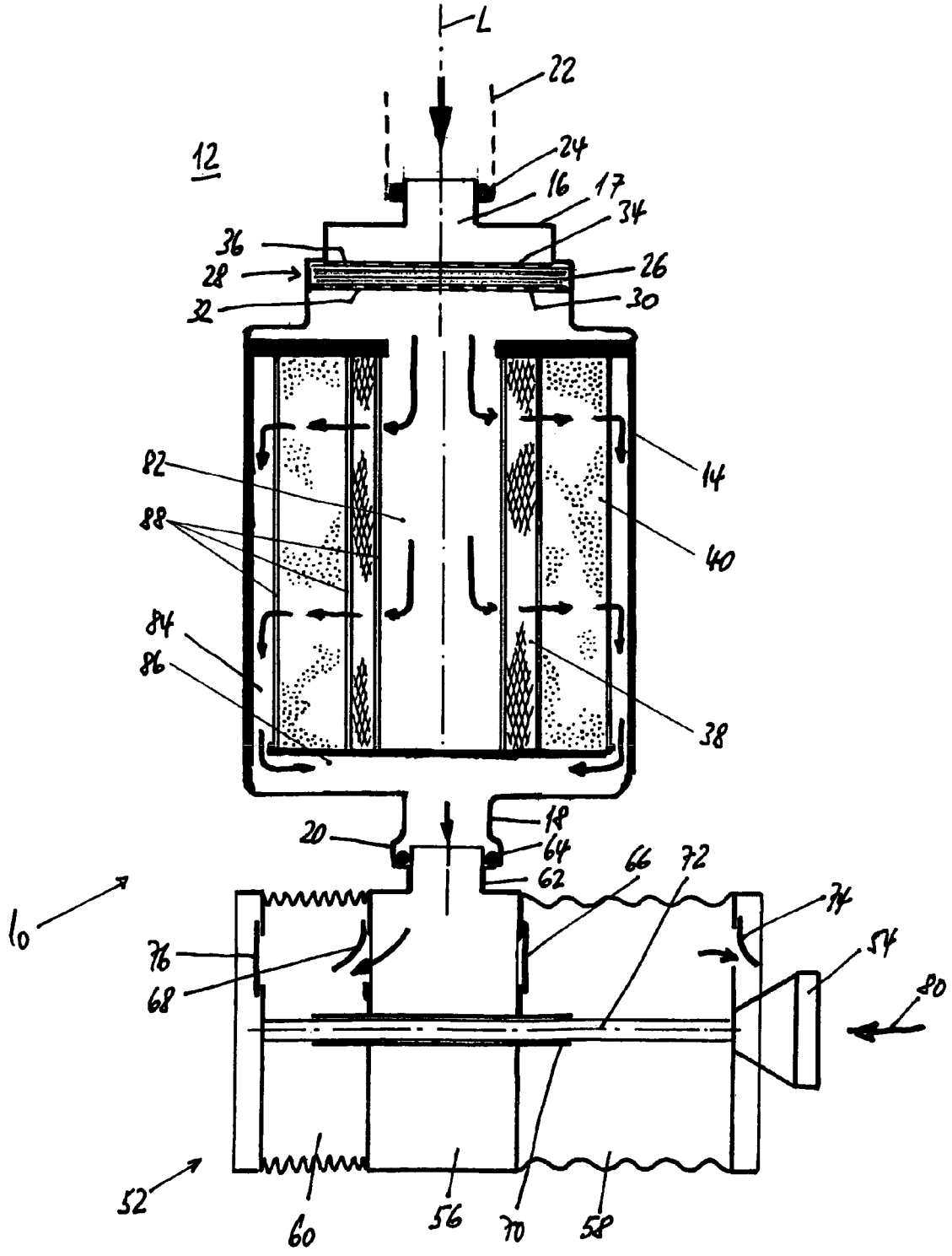
FIG. 3 shows a ventilation system with connected double bellows.

In the event of a movement reversal, i.e. pushing on the operating handle 54, in the direction of the arrow 80 in FIG. 3, a vacuum occurs in the air chamber 60, the outlet valve 76 closes and the suction valve 68 opens. Thus a vacuum occurs in turn in the suction chamber 56, and the suction of external air takes place as when pulling on the operating handle 54. In the air chamber 58, an excess pressure occurs, the suction valve 66 closes, the outlet valve 74 opens and the filtered air can exit into the safety and/or protection space 12. The double bellows 52 according to FIGS. 2 and 3 has an optimum effectiveness and continuously ejects filtered air during the regular back and forth movement of the operating handle 54.

Figure 1:
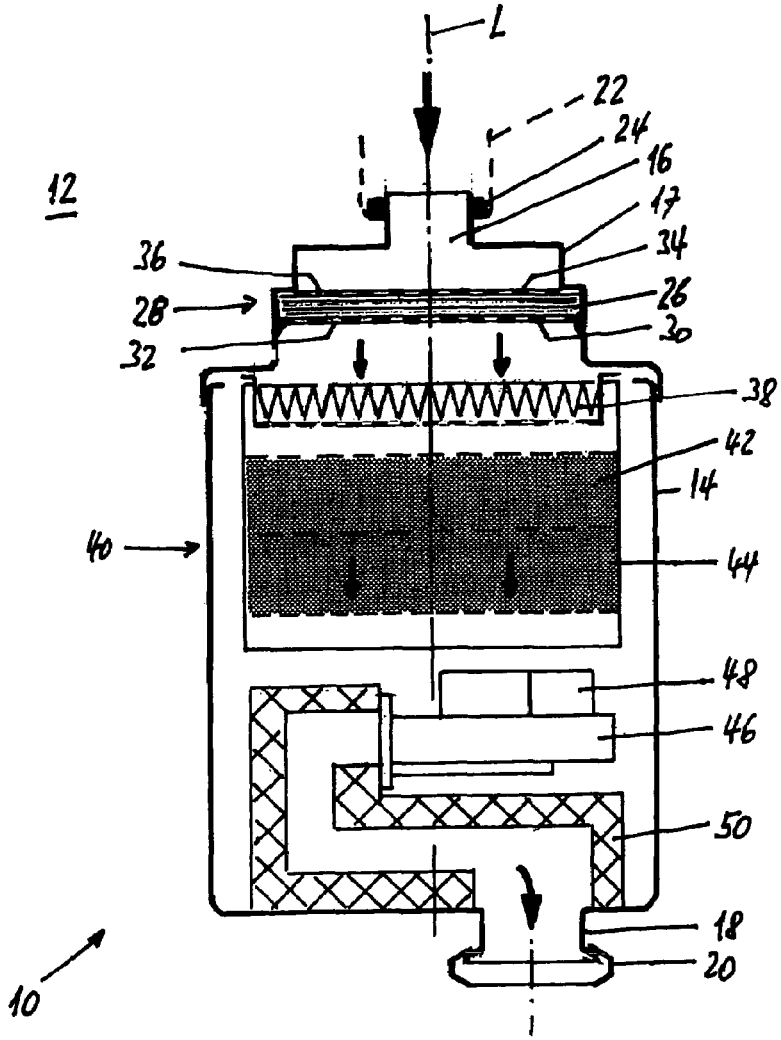
FIG. 1 shows a ventilation system with an electric ventilator.

In the embodiment according to FIG. 3—in contrast to FIG. 1—no ventilator 46 with an electric motor is provided for continuous operation. The ventilation system 10 is exclusively manually operated, in other words corresponds basically to the emergency operation according to FIG. 1.

In the region of the filter 38 for suspended matter and of the activated carbon filter 40, the air guidance according to FIG. 3 is radial, after the prefilter/explosion protection valve 26, 28, the air to be purified enters a central channel 82 and firstly flows through the filter 38 for suspended matter and then also through the annular activated carbon filter 40 and exits into a peripheral annular channel 84. The collected filtered air passes, as indicated by arrows, into a deflection chamber 86 and is sucked in by the double bellows 52.

The filter 38 for suspended matter and the activated carbon filter 40 are supported or limited according to FIG. 3 by air-permeable partitions 88. The activated carbon filter 40 is filled as a granular mixture which simultaneously acts as a C filter 42 and an N filter 44.

Figure 4:
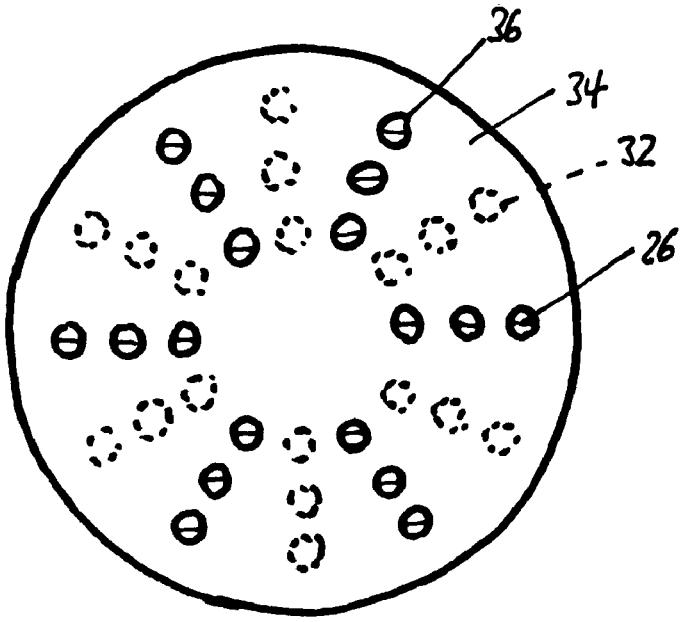
FIG. 4 shows a plan view of a prefilter/explosion protection valve.

A plan view of the moveable plate 34 of an explosion protection filter according to FIG. 4 shows a second perforation 36 with circular holes that are regularly arranged. The prefilter pad 26 between the plate 34 and the identically dimensioned rigidly mounted plate 30 (FIG. 1, 3) of the explosion protection valve 28 is visible through these holes. The first perforation 32 of the plate 30 is indicated by dashed lines. It can also be seen from FIG. 4 that the plates 30, 34 are rotated through 30°. If the prefilter pad 26 keeps the two plates, as shown in FIGS. 1 and 3, at a distance, the air can pass without problems through the first and second perforation 32, 36. If, in an excess pressure phase, in particular an explosion, the moveable plate 34 is presses onto the rigidly mounted plate 30 below, no more air can pass through, because the perforations 32, 36 are not congruent without rotation.

Figure 5:
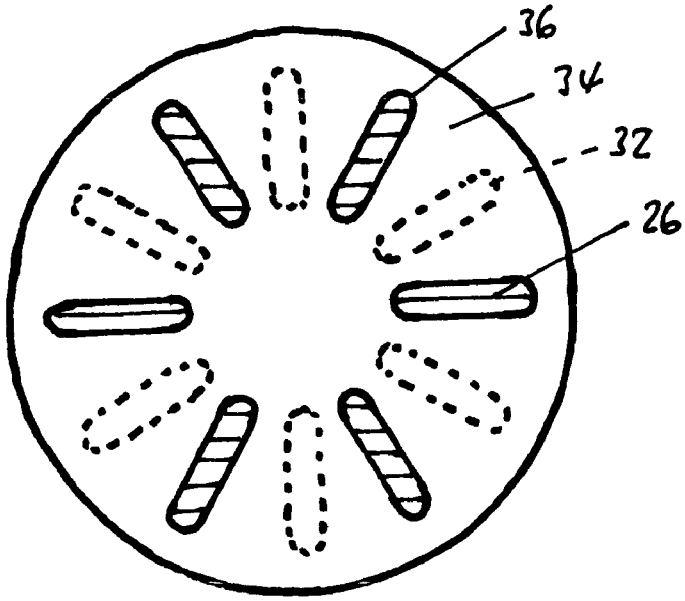
FIG. 5 shows a variant of FIG. 4.

In the embodiment according to FIG. 5, the first and second perforation 32, 36 are configured as slots in the radial direction. The function as an explosion protection filter corresponds to FIG. 4.

The invention claimed is:

1. Ventilation system (10) providing NBC protection for at least one closed security space and/or protection space (12) with constant slight excess pressure, which ventilation system (10) substantially comprises an air inlet (16) and air outlet (18), an explosion protection valve (28), a prefilter (26), a filter (38) for suspended matter, an activated carbon filter (40) and an air conveying device for sucking in the air to be purified and for distributing the purified air, wherein the ventilation system (10) comprises an explosion protection valve (28) which is combined with and cooperates with the prefilter (26); wherein the explosion protection valve (28) comprises an impact-resistant plate (30) having a first perforation (32), rigidly mounted prior to the filter (38) for suspended matter, a prefilter pad (26) which can be elastically compressed and is held upstream from this stationary plate (30) and a moveable plate (34) having a second perforation (36), which can be displaced in the direction (L) of the stationary plate (30).

2. Ventilation system (10) according to claim 1, wherein the first and second perforation (32, 36) are not congruent in the event of striking together due to an explosion and form an air closure.

3. Ventilation system (10) according to claim 1, wherein the explosion protection valve (28) combined with the prefilter (26) is held in a housing cover (17) which is reinforced relative to the remaining housing (14).

4. Ventilation system (10) according to claim 1, wherein the explosion protection valve (28) combined with the prefilter (26) is integrated in a housing (14) of an autonomous built-in unit in the interior of the space.

5. Ventilation system (10) providing NBC protection for at least one closed security space and/or protection space (12) with constant slight excess pressure, which ventilation system (10) substantially comprises an air inlet (16) and air outlet (18), an explosion protection valve (28), a prefilter (26), a filter (38) for suspended matter, an activated carbon filter (40) and an air conveying device for sucking in the air to be purified and for distributing the purified air, wherein the ventilation system (10) comprises a combined activated carbon filter (40); wherein the activated carbon filter (40) comprises a first layer (42) as a C filter and a second layer (44) as an N filter, each layer (42, 44) being effective in any sequence specifically against chemical warfare agents or against radionuclides.

6. Ventilation system (10) according to claim 5, wherein the activated carbon filter (40) comprises a multifunctional layer made of activated carbon which is effective specifically against chemical gaseous toxic substances and an activated carbon which is effective specifically against radionuclides ejected into the atmosphere.

7. Ventilation system (10) according to claim 5, wherein the layers (40, 42, 44) are granulate, powder or configured as an open-pored structure.

8. Ventilation system (10) according to claim 5, wherein the filter (38) for suspended matter and the activated carbon filter (40) are disc-shaped with an axial through-flow direction or annular with a radial through-flow direction.

9. Ventilation system (10) according to claim 1, wherein a power-driven ventilator (46), also fitted with a silencer (50) is used for conveying air in normal operation and an air pump configured as a double bellows (52) can be flanged on in the event of a power failure or defect.

10. Ventilation system (10) according to claim 9, wherein the double bellows (52) comprises a suction chamber (56) mounted on the housing (14) and having an air inlet connection piece (62) for filtered air, two variable air chambers (58, 60) arranged on the end face, each having a suction valve (66, 68) and an outlet valve (74, 76) for alternating actuation, and an operating handle (54) for the double bellows (52)

* * * * *